United States Patent [19]

Seeger

[11] 4,333,544

[45] Jun. 8, 1982

[54] MUFFLER FOR COMBUSTION ENGINES

[75] Inventor: Walter Seeger, Gaggenau, Fed. Rep. of Germany

[73] Assignee: Max Roth KG, Gaggenau, Fed. Rep. of Germany

[21] Appl. No.: 126,318

[22] Filed: Mar. 3, 1980

[30] Foreign Application Priority Data

Mar. 5, 1979 [DE] Fed. Rep. of Germany ..... 2908506

[51] Int. Cl.[3] ..... F01N 1/08

[52] U.S. Cl. ..... 181/266; 181/275

[58] Field of Search ..... 181/250–251, 181/265, 266, 268, 272, 273, 275, 276

[56] References Cited

U.S. PATENT DOCUMENTS

| | | | |
|---|---|---|---|
| 1,023,644 | 4/1912 | Hall | 181/265 |
| 2,397,208 | 3/1946 | Saco et al. | 181/275 X |
| 4,109,755 | 8/1978 | Grueneberg | 181/266 X |
| 4,143,739 | 3/1979 | Nordlie | 181/272 X |

FOREIGN PATENT DOCUMENTS

| | | | |
|---|---|---|---|
| 2638632 | 3/1978 | Fed. Rep. of Germany | 181/275 |
| 546988 | 8/1956 | Italy | 181/273 |
| 615570 | 1/1961 | Italy | 181/275 |
| 435423 | 9/1935 | United Kingdom | 181/275 |

*Primary Examiner*—L. T. Hix
*Assistant Examiner*—Thomas H. Tarcza
*Attorney, Agent, or Firm*—Max Fogiel

[57] ABSTRACT

A muffler for combustion engines in which a housing is subdivided by means of bottoms into at least two successively arranged reflection chambers. Into the first inlet-side reflection chamber an exhaust entry pipe extends. An intermediate channel extends through at least one of inner bottoms from the first into at least one reflection chamber. An exhaust outlet pipe extends from the last reflection chamber out of the muffler, and has at least, in the region of the last reflection chamber, at least one inlet opening. The intermediate channel is arranged in the form of a plurality of intermediate channels which are flowed-through in one and the same direction, and each channel has a small cross-sectional area in relation to the cross-section of the exhaust inlet pipe.

8 Claims, 6 Drawing Figures

MUFFLER FOR COMBUSTION ENGINES

BACKGROUND OF THE INVENTION

Mufflers are known in a variety of types. For example, there are such which operate on the principle of absorption muffling, with the exhaust being supplied by means of pipes formed in their circumference with holes through which the pressure wave can exit uniformly distributed and by means of rock wool surrounding these tubes is muffled to a certain extent. These absorption mufflers are used for example as main mufflers (e.g. DE-OS No. 22 57 854)—also called subsidiary mufflers—in order to particularly muffle the high frequency noise portion of the exhaust gases. In order to obtain a stronger muffling, preliminary mufflers are frequently added to the main muffler (e.g. DE-OS No. 22 57 852). Due to the rock wool filling of the known absorption mufflers a comparatively good muffling effect is obtained. Rock wool is a relatively long-fibered mass which over a period of time is destroyed by the high-frequency component of the pressure wave of the exhaust gases, so that a flour-like residue is obtained. Due to to underpressure existing in the pipe as a result of the out-flowing exhaust gases this flour is entrained and transported to the exterior, which is highly undesirable. Added to this is the fact that the muffler gradually loses its intended function as the destruction of the rock wool proceeds.

For this reason reflection mufflers have become known besides the absorption-type mufflers. Here, analogous to the absorption type mufflers, the exhaust gas passes an "inlet shower" (body with a plurality of outlet openings) into reflection chambers and is then directed via different tubes into diverse additional reflection spaces where the exhaust gas again can escape via outlet openings (e.g. perforated pipes) to finally flow to the exterior the exhaust gas outlet pipe.

The principal used in the reflection-type mufflers thus resides in the fact that the noise is reflected in the reflection chambers by the gas direction and thus is muffled in part by the superposition and the respective outlet from the plurality of small openings into the reflection chamber, particularly with reference to the high frequency noise component.

Disadvantageous in these known mufflers are the transitions between the pipes and the reflection chambers, which results in a high flow resistance and thus back pressure to the engine. Beyond this, only certain frequencies which depend upon the dimensions of the muffler, can be effectively muffled. In particular, high-frequency components are poorly muffled. To avoid restricting the power of the engine too much, it is necessary for obtaining a better flow of the exhaust gases to select the cross section of the pipes relatively large. Since the pipes are, however, guided within the reflection chambers the space necessary for the reflection in the chambers is too small, which in turn results in a poor muffling of the low-frequency noise component. For this reason, the dimensions of the conventional reflection chambers must be made larger. This requires a larger overall dimension of the muffler, so that a compact muffler, as it is for example possible with the absorption-type mufflers, cannot be produced, aside from the higher material requirements which makes these known reflection type mufflers more expensive. Finally, the muffler pot constitutes a hollow body in which the pipes are guided and which air is excited to resonate by their vibrations, which causes disadvantageous radiation noises that do not exist in absorption type mufflers because of the rock wool filling. These disadvantageous noises can be overcome only with large structural expenditures, which again correspondingly are reflected in the manufacturing costs. The task of the invention is to provide a muffler according to the preamble of the claim 1 with good damping effect over as large as possible a frequency range, particularly high-frequency noise proportion without increased losses at small structural size and low body noise radiation.

The plurality of mutually parallel intermediate channels has by comparison to the cross-section of the exhaust gas inlet pipe a large total cross-section, so that the inflowing of the exhaust gases from the first outer reflection chamber into the intermediate channels causes only a very small flow resistance. Because of this only practically negligible losses in efficiency of the combustion engine are observed. Added to this is the fact that good muffling of the high-frequency noise component is obtained in that the wall surface of all channels combined is larger by a multiple than in the known constructions. One obtains a correspondingly high friction value and a good radiation into the reflection chambers, which is advantageous for muffling low-frequency noise components. In contradistinction to the state of the art, the muffling thus is effected in the first line not by the gas transmission from the pipe to the reflection chamber, but by the inventively provided plurality of intermediate channels themselves. Due to the large number of these relatively narrow intermediate channels the volume of the reflection chambers also is not so strongly reduced, so that the still available reflection chamber volume advantageously influences the muffling effect. According to the invention it is thus not necessary, in contradistinction to the state of the art, to increase the size of a muffler constructed in accordance with the invention, in order to muffle low-frequency noise components; nevertheless, a large friction surface is made available for muffling higher-frequency noise components without causing an increase in the efficiency loss of the combustion engine.

SUMMARY OF THE INVENTION

Advantageously, the intermediate channels are guided along the outer wall of the muffler, whereby a very stable wall construction of the muffler is obtained, so that this is practically incapable of acting as a self-vibrating resonance body, so that body noises are not yielded to any effective extent as in the reflection-type mufflers according to the state of the art. In a particularly preferred embodiment of the invention, the intermediate channels are formed at the inner side of the wall of the housing, particularly in such a manner that the inner side of the wall forms a partial wall area of the intermediate channels. This can preferably be obtained in a simple manner by the use of a sheet metal which is corrugated, in triangles or at any other desired angle, so that contact zones are obtained extending throughout in longitudinal direction and with which the sheet metal engages the inner surface of the wall and between which channel-shaped hollow spaces are formed. The channels are preferably provided closely adjacent one another over the entire circumference of the wall, so that a large total cross-section is obtained which due to its annular shape provides for good inflow conditions. The wall is reinforced and with respect to its resonant frequency moved outside of the occurring spectrum. Surrounded by the channels there remains a large resonator space for muffling the lower-frequency components of the frequency spectrum.

A particularly elegant embodiment is considered to be obtained by providing the intermediate channels for tuning to certain noise frequencies with small cross-sectional differences and/or with openings which are appropriately offset in longitudinal direction.

In a further preferred embodiment of the invention more than two reflection chambers are provided. Beyond this, a building block type construction is envisionable for accommodation to different engines.

In a preferred embodiment of the invention a resonator space is located ahead of the first outer reflection chamber and therein a suction resonator which in advantageous construction is made as a knee-shaped pipe that has an opening in the region of the outer curvature of the knee. Due to this suction resonator the advantage is obtained that the reflection of the explosion pressure wave coming from the combustion engine cannot be prevented, but is reflected only in a strongly muffled manner to the combustion engine. Finally, the exhaust gas outlet pipe passing through the right outer reflection chamber can be surrounded by a resonator chamber which in turn causes a muffling of the pressure waves of the exhaust gases which expand in this chamber, whereby the good damping characteristics of the muffler constructed according to the invention are further improved in frequency ranges to be determined thereby.

Further characteristics of the invention are obtained in conjunction with the embodiments illustrated in the drawing, to which reference is particularly made and which hereinafter description explains the invention in more detail.

DESCRIPTION OF THE PREFERRED EMBODIMENTS

Figure 1:
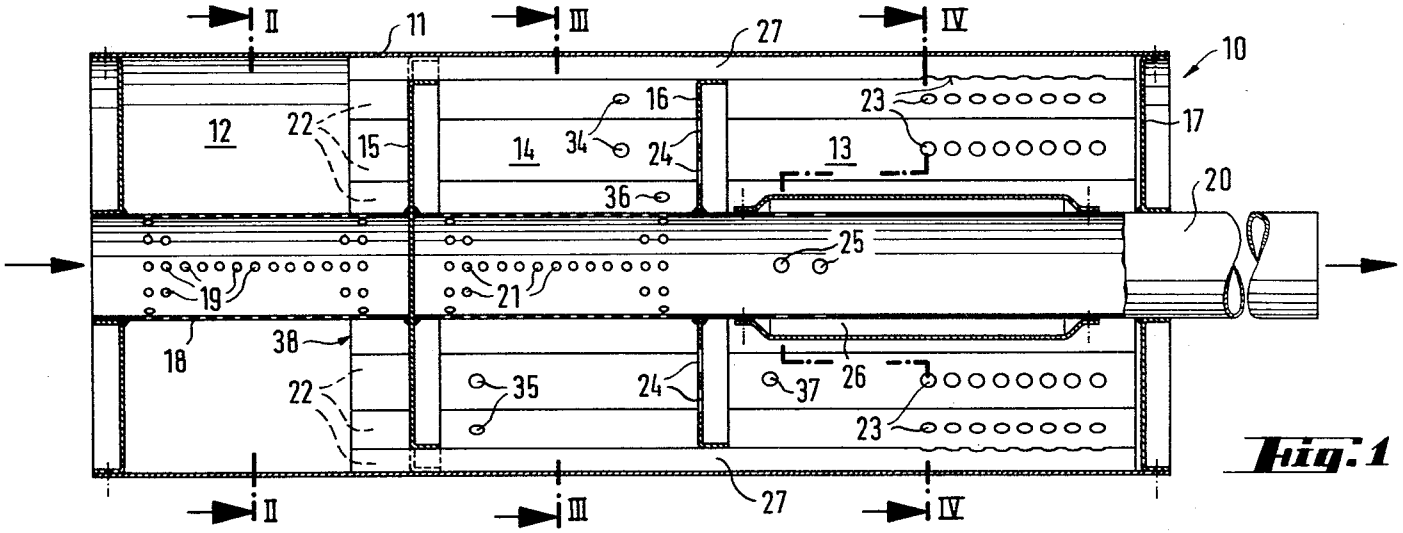
FIG. 1 shows a first embodiment, in cross-section.

The muffler designated in toto with reference numeral 10 in FIG. 1 for a combustion engine has a housing 11 with a total of three successively arranged reflection chambers, namely a first outer chamber 12, a second outer chamber 13 and a last reflection chamber 14 which are separated by means of their arranged inner bottoms 15, 16 and an outlet bottom 17 for the second outer chamber 13.

The exhaust inlet pipe 18 extends into the first outer chamber 12 and is closed at its end by means of the inner bottom 15 and formed in the wall region with a plurality of holes 19. Registering with this exhaust inlet pipe there is provided at the other side of the inner bottom 15 the exhaust outlet pipe 20 which is provided in the region of the last chamber 14 with inlet openings 21.

A plurality of mutually parallel intermediate channels 22 is provided, extending from the first outer chamber 12 at the inner side of the housing 11 respectively at the inner wall of the muffler 10, of which each has with reference to the cross-section of the exhaust inlet pipe 18 a small cross-section, with the sum of the small cross-sections being larger than that of the exhaust inlet pipe. These intermediate channels 22 are extended through the last reflection chamber 14 and extending to the outlet bottom 17 of the second outer chamber. In following the outlet bottom 17 the intermediate channels 22 are provided with holes 23 through which the exhaust gas can enter into the reflection chamber 13.

The exhaust gases which travel in this manner from the first outer reflection chamber 12 to the second outer reflection chamber 13 then enter after a deflection with reference to the holes 23 through 90°, through the inner bottom 16 provided with the passage holes 24 into the last reflection chamber 14 and from there travel through the inlet openings 21 into the exhaust outlet pipe 20. Further transition possibilities are obtained by the openings 27 which are formed between the intermediate channels and the outer wall region of the inner bottom, as will be described below with reference to FIG. 3.

In the region of the second outer reflection chamber 13 the exhaust outlet pipe 20 is provided with coupling holes 25 which communicate with a resonator chamber 26 surrounding the outlet pipe 20.

For the absorption of certain interference frequencies in the noise spectrum, and to that extent to the uniform muffling thereof, a desired number of the intermediate channels may be provided with tuning openings 34–37. The tuning openings are axially offset in different intermediate channels for different frequencies, as indicated by the different reference numerals 34–37, several channels 22 may have tuning openings at the same axial level as indicated by 34 and 35. In the intermediate channels respectively a part thereof may also be constructed with cross-sectional sizes which differ slightly from one another or with several differential cross-sectional sizes in order to obtain in an analogous manner an absorption of differential frequencies.

Figure 4:
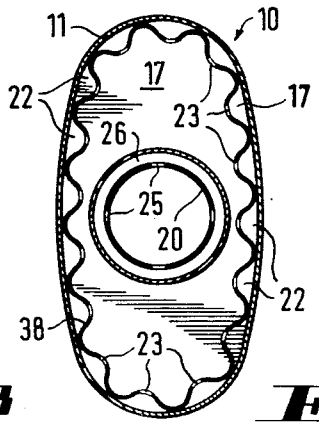
FIG. 4 a section IV—IV according to FIG. 1.
Figure 3:
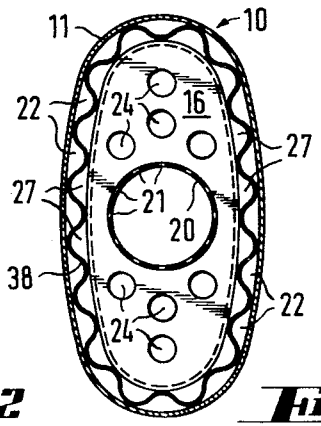
FIG. 3 a section III—III according to FIG. 1.
Figure 2:
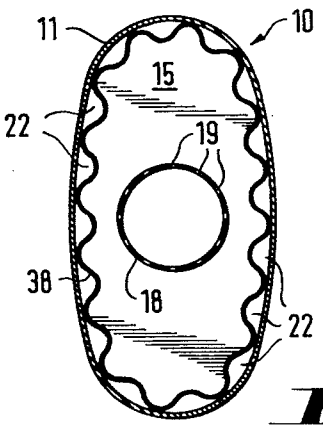
FIG. 2 a section II—II according to FIG. 1.

As shown in FIGS. 2–4, the housing 11 of the muffler 10 is of approximately oval cross-section and the exhaust inlet pipe 1 (FIG. 2) as well as the exhaust outlet pipe 20 (FIGS. 3 and 4) are symmetrically arranged in the housing 11. The intermediate channels 22, which in principle may have any desired cross-sectional shape and may for example be defined by tubes, are here configurated in a simple manner in that a corrugated sheet metal is arranged at the inner side of the wall of the housing 11. The inner bottom 15 has extended up closely to the edge of the intermediate channels 22, so that the gas transition from the first outer reflection chamber 12 to the chamber 13 can take place only via the intermediate channels. The inner bottom 16 has an axially extending margin so that the openings 27 defined between this margin and the intermediate channels have the character of axially extending channels which form resonators. These resonators can be tuned to different frequencies by axially differentially dimensioned marginal construction of the inner bottom 16, for example by forming the outer marginal shape in the form of a circular section inclined to the longitudinal axis.

Figure 5:
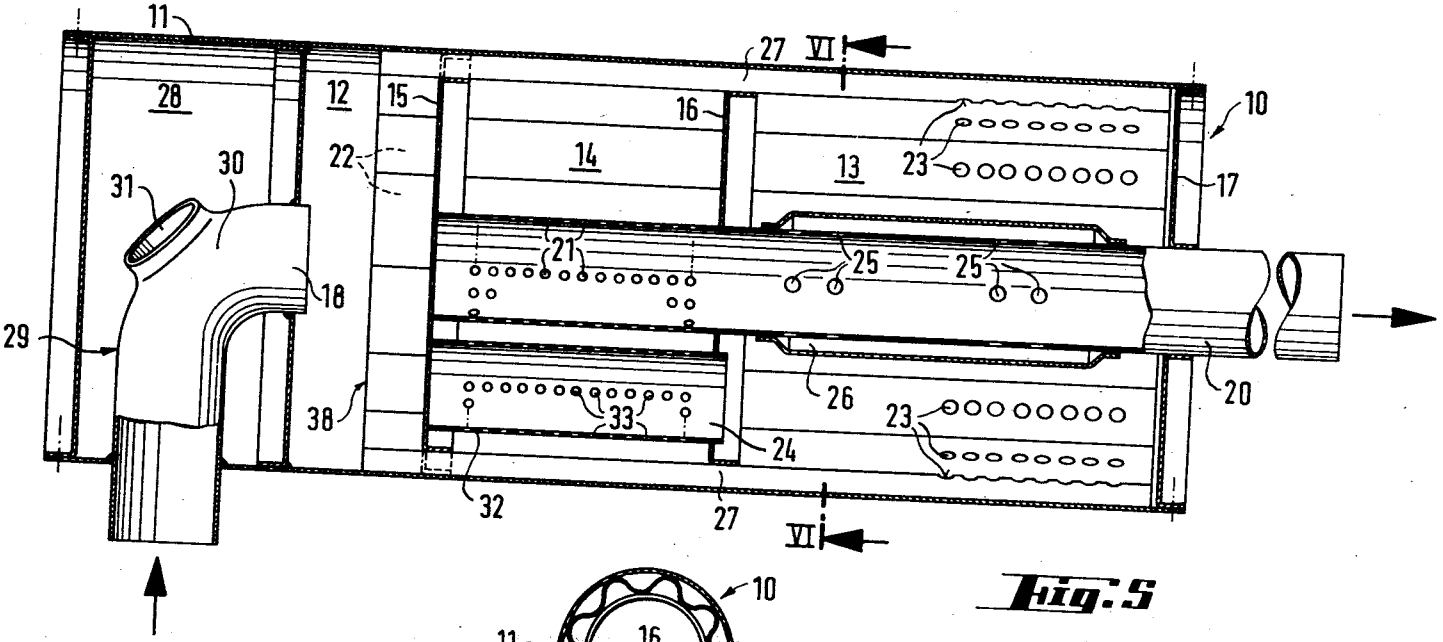
FIG. 5 a second embodiment of the invention, in cross-section.
Figure 6:
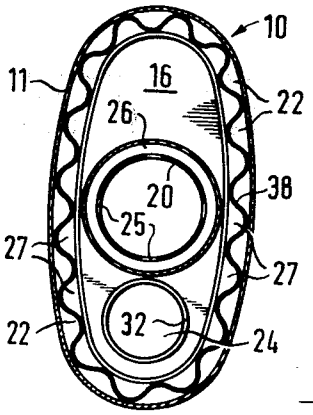
FIG. 6 a section VI—VI according to FIG. 5.

A second embodiment of the invention is shown in FIG. 5. Like parts corresponding to the embodiment in FIG. 1 are designated in this figure with like reference numerals. The second outer reflection chamber 13 of this second embodiment corresponds identically to the one in FIG. 1; the outer first reflection chamber 12, however, corresponds to the one in FIG. 1 only with the difference that the exhaust inlet pipe 18 communicates with its free pipe cross-section with the chamber 12. Further, ahead of the chamber 12 there is arranged a resonator space 28 into which the exhaust inlet pipe 18 serving as a suction resonator 29 extends. For this purpose, in this particular embodiment the exhaust inlet pipe 18 is configured as a knee-shaped pipe in the outer curvature range 30 of which an opening 31 is provided. The outlet of this suction resonator 29 is arranged approximately in registry with the exhaust outlet pipe 20.

It is further to be pointed out that a different construction of the inner bottom 16 and the last reflection chamber 14 are provided. The inner bottom 16 corresponds in its marginal shape here to the one of the inner bottom 15 and has only a single passage hole 24 from which a resonator pipe 32 extends essentially parallel to the exhaust gas outlet pipe 20 to the inner bottom 15, through which it is closed. This resonator pipe is provided in its wall with holes 33.

The exhaust gas entering into the reflection chamber 13 flows through this resonator pipe and issues from the holes 33 to the reflection chamber 14 and from there passes through the inlet opening 21 in the exhaust gas outlet pipe 20.

What is claimed is:

1. Muffler for muffling high frequency portion of noise in combustion engines, comprising a housing subdivided by bottoms into at least two successively arranged reflection chambers, one of said chambers being a first inlet-side reflection chamber with an extending exhaust entry pipe, intermediate channel means extending through at least one inner bottom from a first into at least one reflection chamber, an exhaust outlet pipe extending from the last reflection chamber out of the muffler and having at least in the region of the last reflection chamber at least one inlet opening, said intermediate channel means having a plurality of intermediate channels which are flowed-through in one and the same direction, each channel having a small cross-sectional area in relation to the cross-section of the exhaust inlet pipe, said reflection chambers comprising a first outer reflection, a second outer reflection and a final reflection chamber, said intermediate channels passing outside the final reflection chamber located between the intermediate channels from the first outer reflection chamber into the second outer reflection chamber, exhaust passing into said final reflection chamber only after having left said second reflection chamber, the exhaust passing from said final reflection chamber into said exhaust outlet pipe, said intermediate channels being formed on the inner side of the wall housing; a sheet metal formed under a predetermined angle with corrugations at the inner side of the wall and forming together with the inner side of the wall said intermediate channels; said intermediate channels having a plurality of holes over a part of their length in the second outer reflection chamber which is adjacent the outlet bottom; an inner bottom next adjacent an outer bottom and having at least one passage hole; a resonator pipe closed at an end and connected to said passage hole, said resonator having holes in its wall; said exhaust outlet pipe being closed at its end associated with the muffler and extending from the last reflection chamber through an outlet bottom, a resonator space being located ahead of the first outer reflection chamber, and an exhaust inlet pipe arranged in said resonator space and constructed as a suction resonator, said suction resonator comprising a knee-shaped pipe, an opening being arranged in the region of the outer bend of the knee, said outlet opening being substantially in registry with the exhaust outlet pipe, the sum of the small cross-sectional areas of said channels being larger than the cross-sectional areas of said exhaust entry pipe, a predetermined number of said intermediate channels having tuning openings axially offset in different intermediate channels for different frequencies, said housing having a substantially oval cross-section, said exhaust entry pipe and said exhaust outlet pipe being arranged symmetrically in said housing, said intermediate channels being defined by tubes formed from corrugated sheet metal.

2. Muffler as defined in claim 1, wherein said intermediate channels are in part formed by the inner side of the wall.

3. Muffler as defined in claim 1, wherein said intermediate channels are distributed over the entire inner interior circumference of the wall, substantially the entire inner surface of the wall serving the channel formation.

4. Muffler as defined in claim 1, wherein all intermediate channels have the same cross-sectional size.

5. Muffler as defined in claim 1, wherein at least part of the intermediate channels has different cross-sectional sizes.

6. Muffler as defined in claim 1, wherein at least a part of the intermediate channels has respectively axially differently positioned matching openings.

7. Muffler as defined in claim 1, wherein the exhaust outlet pipe is closed at an end in the interior of the muffler by an inner bottom.

8. Muffler as defined in claim 1, wherein the exhaust outlet pipe is surrounded in the region of the second outer reflection chamber by a resonator chamber arranged in the same and has coupling holes communicating therewith.

* * * * *